United States Patent [19]

Graybeal

[11] 4,414,915

[45] Nov. 15, 1983

[54] ROTARY SCREEN SQUEEGEE ROD

[75] Inventor: Harold N. Graybeal, Lancaster, Pa.

[73] Assignee: Armstrong World Industries, Inc., Lancaster, Pa.

[21] Appl. No.: 360,787

[22] Filed: Mar. 22, 1982

[51] Int. Cl.[3] ..... B41L 13/18; B05C 1/00

[52] U.S. Cl. ..... 118/213; 101/120; 118/406; 335/285; 403/292

[58] Field of Search ..... 101/119, 120, 382 MU; 70/413, 276; 292/251.5; 335/285, 286, 287, 306; 118/119, 121, 122, 126, 406, 213, 620; 403/292

[56] References Cited

U.S. PATENT DOCUMENTS 3,988,986 11/1976 Zimmer ..... 101/119

4,014,289 3/1977 Zimmer ..... 101/119 X 4,094,241 6/1978 Kössler ..... 101/120

4,228,667 10/1980 Herriott ..... 70/413 X

FOREIGN PATENT DOCUMENTS 2437006 2/1976 Fed. Rep. of Germany ..... 101/119

*Primary Examiner*—Edgar S. Burr

*Assistant Examiner*—Moshe I. Cohen

[57] ABSTRACT

Herein is a modification of a conventional rotary screen printer wherein steel slugs are positioned inside a hollow squeegee rod to line up with heavy print areas. When more magnetic force is applied to the steel slugs, less ink is deposited since the screen is held tighter against a nonporous substrate.

2 Claims, 4 Drawing Figures

FIG. 1
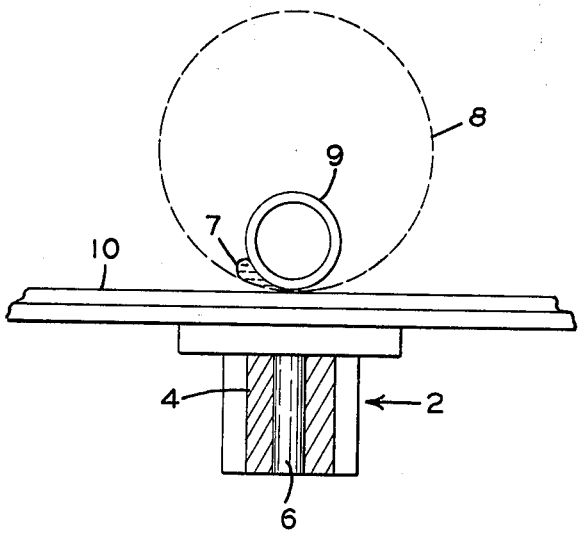
FIG. 2
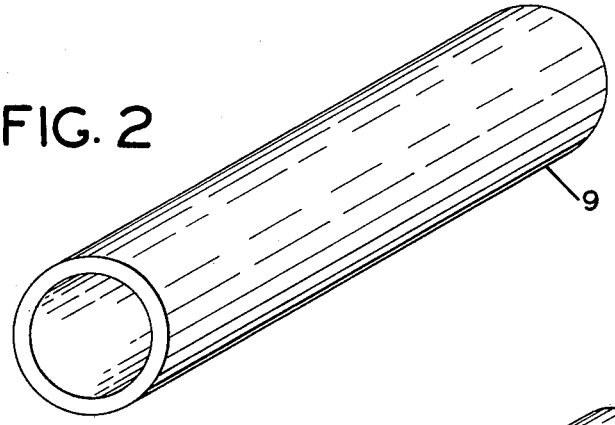
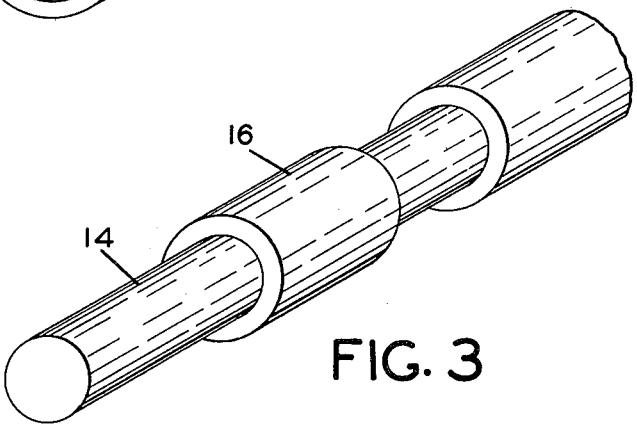
FIG. 3

ROTARY SCREEN SQUEEGEE ROD

BACKGROUND OF THE INVENTION

1. Field of the Invention

The invention relates to a device for treating one surface of a web by means of at least one roller shaped working member, especially a roller squeegee, which is attracted by a magnetic element situation on the other side of the web.

2. Description of the Prior Art

U.S. Pat. No. 4,014,289 shows the conventional rotary screen printer with a squeegee rod 9.

SUMMARY OF THE INVENTION

The invention is directed to a device for treating a web of material. The device includes at least one roller shaped element formed of magnetically attractable material, and this element is positioned on one side of a web to be treated. A means supplies a treating substance to one side of the web of material and a magnetic element positioned on the opposite side of the web of material attracts the magnetically attractable roller shaped element. This forces the roller shaped element against one side of said web of material, and this forces the treating substance into the one side of said web of material. The improvement comprises the making of the roller shaped element as a hollow rod. Steel slugs of different lengths are fitted within said rod and are placed at different positions along the length of the rod in areas where it is desirable to apply more pressure against the web of material.

These steel slugs are solid and wood dowels between the different slugs position these slugs in position.

These steel slugs are hollow and are positioned at different points along a wood rod which is the same length as the hollow rod. The wood rod with the steel slugs is inserted into the hollow rod.

BRIEF DESCRIPTION OF THE DRAWING

FIG. 1 is an end view of a conventional rotary screen printer;

FIG. 2 is a perspective view of a hollow squeegee rod; and

FIG. 3 is a perspective view of the invention herein which is inserted into the rod of FIG. 2.

DESCRIPTION OF THE PREFERRED EMBODIMENT

Figure 4:
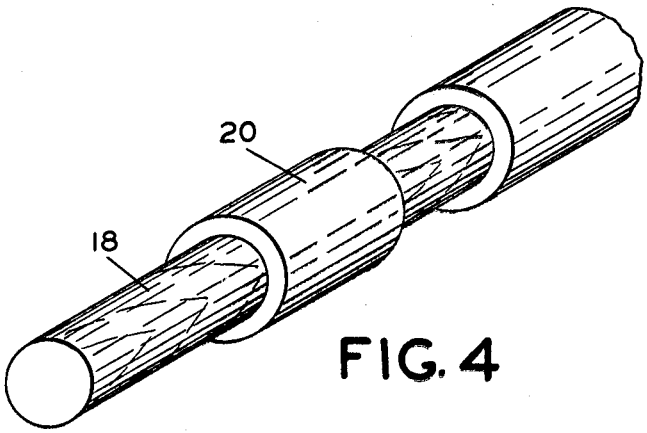
FIG. 4 is a perspective view of a modification of FIG. 3.

The invention is directed to a modification of presently used hollow squeegee rods for the purpose of reducing or eliminating streaks being caused by variations in the magnetic field strength or by other defects in the printer or substrate being printed. The invention can also be used to solve the problem of the bowing of a long hollow squeegee rod.

When using the Zimmer rotary screen printer, such as that shown in U.S. Pat. No. 4,014,289, a steel rod is used to force ink 7 through the holes in the screen 8. The rod can be made from solid steel or from a hollow pipe. An electromagnet is used to apply the proper force needed to obtain the satisfactory print. The magnetic coils are located underneath the print belt and there is some variation in the magnetic field due to electrical differences in coils, spacing differences between the coils and the belt, and spacing differences between one magnet bed to another. Where there is a lower magnetic field, there will be a heavier applied deposit of ink when printing on a nonporous type of material, or onto a material with very little compressive ability. By positioning the steel slugs of the invention herein, inside a hollow rod to line up with the heavy print areas, increased force is applied due to the magnetic lines of force cutting through more steel than at the areas where there is no slug. When more force is applied, less ink is deposited since the screen is held tighter against the nonporous substrate. Also, the gauge variations in the rubber belt where the rubber conveyor belt is sliced can cause print defects. The steel slug can be used in this area also. By positioning the slugs inside the hollow squeegee rod which is covered with a nonporous rubber covering, almost any type of print defect can be eliminated or reduced.

On very wide printers, bowing of the squeegee rod will occur. By positioning a steel rod in the center, more force can be applied to keep the center of the rod directly over the center line of the magnet, reducing the amount of bowing.

Referring to FIG. 1, there is shown the conventional rotary screen printer such as that shown in U.S. Pat. No. 4,014,289. The magnetic element 2 of FIG. 1 has a series of coils 4 positioned around a magnetic core 6. A plurality of these coils and cores can extend side by side under the web to be printed. The magnetic element 2 attracts the squeegee rod 9 which is shown as being a hollow rod. This works in conjunction with a stencil 8 to force printing ink into the web of material 10 which may be carried on a rubber conveyor belt 12. This structure is all conventional in the art.

FIG. 2 is a showing of the hollow squeegee rod 9.

FIG. 3 shows the inventive concept herein wherein a wooden dowel 14 is provided with a plurality of hollow steel slugs 16 which have an inside diameter sized to permit them to be frictionally held on the wood dowel 14 and an external diameter which will permit them to be slid within the hollow portion of the squeegee rod 9. Consequently, by positioning the slugs on different points along the wood dowel and then inserting the wood dowel into the squeegee rod 9, these slugs will be positioned at different points within the hollow steel rod. Solid slugs or rods can be used inside the hollow squeegee rod to obtain greater magnetic pull. These solid steel slugs 16 can be positioned inside the hollow squeegee rod using pieces of wooden dowel 14, or other non-magnetic material 18, cut to act as spacers placed between the solid steel rods 20 (see FIG. 4). As with the use of hollow steel slugs slipped over a wooden rod and placed inside the hollow squeegee rod, the end caps on the hollow squeegee rod will hold the steel slugs and wooden dowel spacers inside the hollow squeegee rod. In the vicinity where the steel slugs exist, there will be a greater magnetic attraction to the magnetic means 2 than in those areas where there are no steel slugs.

What is claimed is:

1. In a device for treating a web of material, said device being the type including at least one roller-shaped element formed of magnetically attractable material, said roller-shaped element being positioned on one side of the web of material to be treated and comprising means for applying a treating substance to said one side of said web of material, and a magnetic element positioned on the opposite side of said web of material, said magnetic element including a series of electromagnets arranged one after the other in a longitudinal direction across the width of the web of material, said magnetic element being means for attracting said roller-shaped element and thereby forcing said roller-shaped element against one side of said web of material; the improvement comprising:

said roller-shaped element being a hollow steel rod, steel slugs of different lengths fitting within said rod and being positioned in different positions along the length of the rod, the steel slugs being hollow and positioned at different points on a wooden rod the same length as the hollow rod, said wood rod with steel slugs being inserted in the hollow rod.

2. In a device for treating a web of material, said device being the type including at least one roller-shaped element formed of magnetically attractable material, said roller-shaped element being positioned on one side of the web of material to be treated and comprising means for applying a treating substance to said one side of said web of material, and a magnetic element positioned on the opposite side of said web of material, said magnetic element including a series of electromagnets arranged one after the other in a longitudinal direction across the width of the web of material, said magnetic element being means for attracting said roller-shaped element and thereby forcing said roller-shaped element against one side of said web of material; the improvement comprising:

said roller-shaped element being a hollow steel rod, steel slugs of different lengths fitting within said rod and being positioned in different positions along the length of the rod, the steel slugs being solid and positioned at different points within the hollow steel rod, said slugs being maintained in position by pieces of wood dowel positioned between the slugs.

* * * * *